United States Patent [19]

Dantlgraber

[11] Patent Number: 4,697,996

[45] Date of Patent: Oct. 6, 1987

[54] ROTARY PUMP WITH ADJUSTABLE CAM RING

[75] Inventor: Jörg Dantlgraber, Lohr-Sackenbach, Fed. Rep. of Germany

[73] Assignee: Mannesmann Rexroth GmbH, Lohr, Fed. Rep. of Germany

[21] Appl. No.: 864,860

[22] Filed: May 20, 1986

[30] Foreign Application Priority Data

May 20, 1985 [DE] Fed. Rep. of Germany ..... 3518090

[51] Int. Cl.[4] ..... F04C 2/344; F04C 15/04

[52] U.S. Cl. ..... 418/31; 417/220

[58] Field of Search ..... 418/24–27, 418/30, 31; 417/219–221; 91/497

[56] References Cited

U.S. PATENT DOCUMENTS

| | | | |
|---|---|---|---|
| 2,600,633 | 6/1952 | French | 418/27 |
| 3,373,692 | 3/1968 | Klessig et al. | 418/27 |
| 4,340,338 | 7/1982 | Lemke | 418/31 |
| 4,392,795 | 7/1983 | Smith | 418/31 |

*Primary Examiner*—John J. Vrablik

*Attorney, Agent, or Firm*—Cushman, Darby & Cushman

[57] ABSTRACT

The invention relates to a hydraulic vane type pump and to a radial piston pump. The cam ring of said pumps is adapted for horizontal and vertical movement. So as to achieve stable operating conditions for the pump at least within a certain range, a single-piece support body is mounted within the vertical adjustment screw so as to avoid a change in the level of height when the cam ring is moved axially.

6 Claims, 8 Drawing Figures

ROTARY PUMP WITH ADJUSTABLE CAM RING

The invention is directed to an adjustable vane-type pump having a cam ring which can be adjusted in horizontal direction as well as in vertical direction. The adjustment for the cam ring in vertical direction, i.e. the height level adjustment of the cam ring, is preferably carried out by means of a level adjustment screw.

The invention is also directed to a radial piston pump having an adjustable cam ring. Vane-type pumps having a unitary rigid level adjustment screw are already known. A disadvantage of such pumps resides in the fact that the cam ring can tilt with the consequence that the pump breaks down. Further, from the German laid-open application No. 23 57 182, a vane-type pump is known which avoids the occurence of a tilt moment, i.e. a force causing a tilt movement. However, with such a pump, the control characteristic of the pump can be influenced in an undesirable manner when the cam ring is adjusted horizontally.

It is an object of the present invention to overcome the disadvantages of the prior art. It is another object of the invention to design a vane-type pump or a radial piston pump in such a manner that no tilting moment is applied to the cam ring.

In accordance with a further object of the invention, a vane-type pump and a radial piston pump are designed such that the control characteristic of the pump is not subject to an undesired influence.

SUMMARY OF THE INVENTION

In accordance with the invention, an adjustable vane-type pump or radial piston pump is provided. Said pump comprises a housing within which a cam ring is located. A rotor is rotatably mounted within said cam ring. Means are provided for adjusting the cam ring in horizontal direction so as to change the amount of fluid supplied by the pump. Further, supporting means are arranged within a height or level adjustment screw which is adapted to adjust the desired height level of the cam ring. The supporting means are mounted in said height adjustment screw in such a manner that for an adjustment of the cam ring in horizontal direction, the height level of the cam ring is not changed within a certain range of horizontal adjustment.

In accordance with a preferred embodiment of the invention, the supporting means comprise a unitary supporting body. Said supporting body comprises a spherical surface adapted for being pivotally mounted in the adjustment screw. Said supporting body further comprises an abutment surface for abutment with the outer surface of the cam ring.

In accordance with another embodiment of the invention, the supporting body comprises a spherical section and a cylinder section.

In accordance with a further embodiment of the invention, the abutment surface of the supporting body is of planar design. Further, the supporting surface of the supporting body is of spherical shape, said sphere having a predetermined radius r. In accordance with the preferred embodiment $a > \mu \times r$, with a being the radius of the cylinder section, $\mu$ being the friction coefficient and r being the radius of the spherical section. In accordance with another embodiment, $r \times \mu > e/3$ with r being the radius of the spherical section, $\mu$ being the friction coefficient and e being the maximum eccentricity of the cam ring in the direction of the horizontal axis.

Additional advantages, details and objects of the invention may be found in the following description of embodiments shown in the drawing: in the drawing FIG. 1 is a schematic cross-sectional view along ling 1—1 in FIG. 2 showing a vane-type pump of the prior art;

Figure 7:
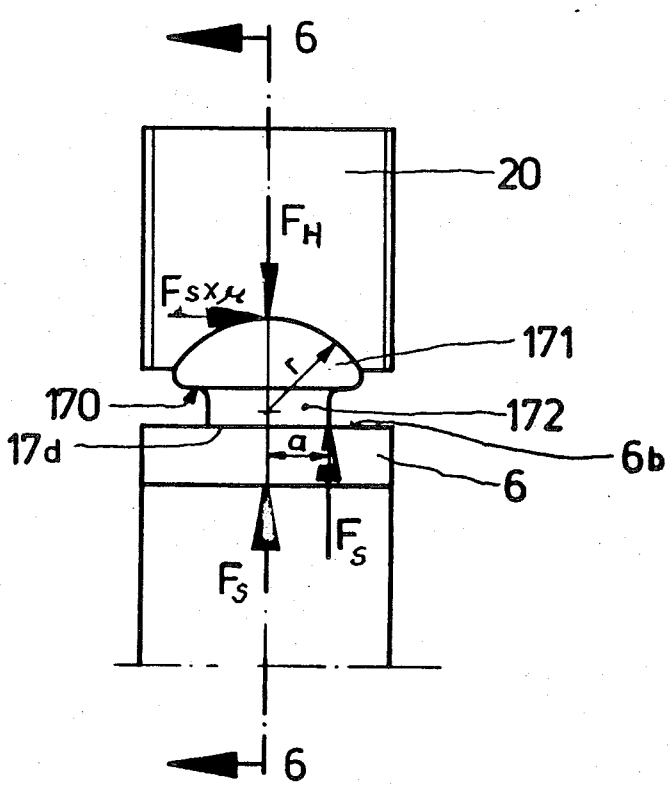
FIG. 7 is a sectional view along line 7—7 in FIG. 6.
Figure 8:
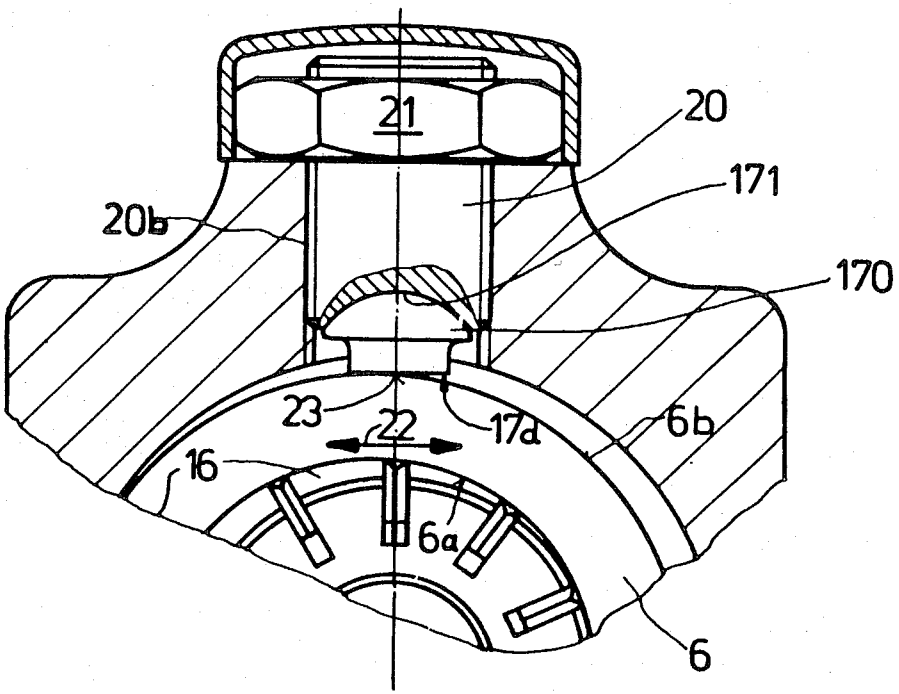
FIG. 8 is a detailed partial cross-sectional view similar to FIG. 6 showing the pump of FIG. 5, with only the inventive part of the pump of FIG. 5 being shown.

The following description relates to a first prior art vane-type pump in connection with FIGS. 1 and 2, and thereupon a second prior art vane-type pump will be discussed together with FIGS. 3, 4 and 5. FIG. 8 then discloses the invention in the framework of a vane-type pump of FIG. 5. The schematic representations of FIGS. 6 and 7 serve for a detailed explanation of the function of the pump of the invention.

While the following description refers to the invention in the context of a vane-type pump, the invention can also be used in a radial piston pump.

In short, the present invention relates to the design of the support means which are used for supporting the cam ring in vertical direction or with respect to the height level of the cam ring. The supporting means shown in FIGS. 1 and 2 as well as 3 to 5 have disadvantages which will be overcome by the supporting means of the invention shown in FIGS. 6 to 8.

The following description refers to partial views sufficient for a man skilled in the art. Specifically, FIG. 5 discloses the design of a vane-type pump in a cross-sectional view in some detail. FIG. 2 discloses that generally the housing is closed on one side by a control disc and on the other side by a cover disc. The control disc and cover disc are supported by the housing or a component of the housing.

Figure 2:
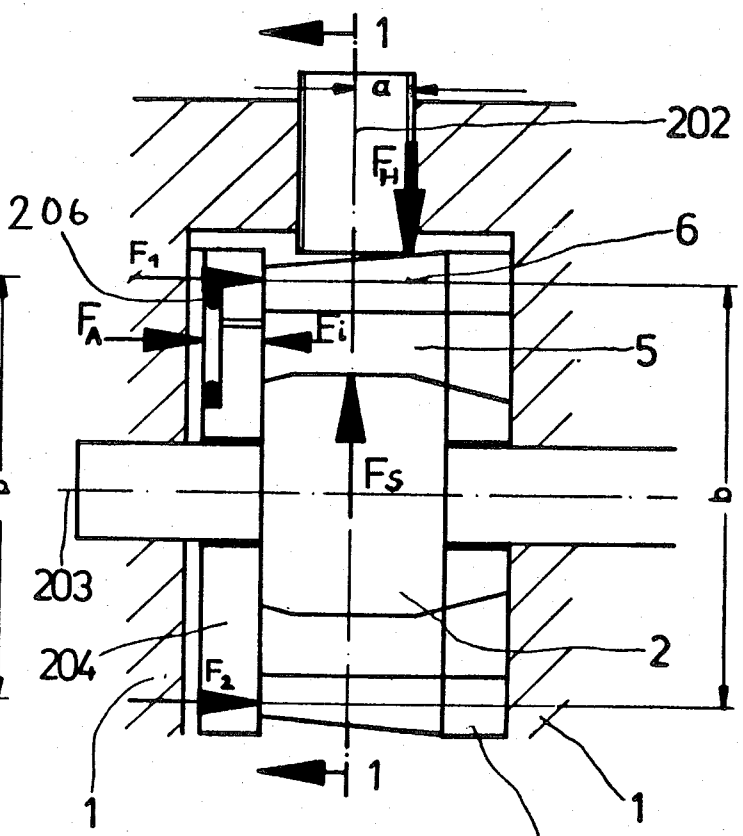
Fig. 2 (PRIOR ART)
FIG. 2 is a schematic longitudinal cross-sectional along line 2—2 in FIG. 1.
Figure 1:
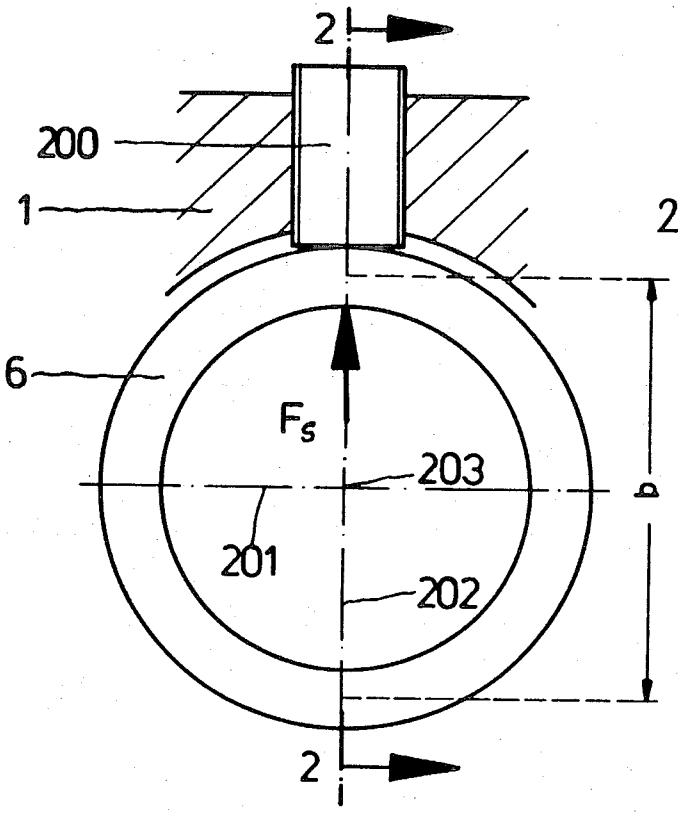
Fig. 1 (PRIOR ART)

The vane-type pump of FIGS. 1 and 2 comprises a housing 1. A cam ring 6 is movably mounted within said housing 1. The cam ring 6 can be moved in the direction of the horizontal axis 201 so as to change the volume supplied by the pump.

Moreover, the cam ring 6 may be moved in the direction of vertical axis 202, i.e. the cam ring 6 can be adjusted to a specific height level. In order to carry out the adjustment of the height level, a height level adjustment screw 200 is provided. The height level adjustment screw 200 is located in thread means in the housing 1 and can be adjusted in accordance with the desired height level. In the direction of the longitudinal axis 203, discs are provided at both sides of the housing 1: on one side the control disc 205 is provided and on the other side the cover disc 204 is located. The pumps of the prior art shown here, as well as the pump of the invention, are each provided with one suction kidney opening and an output kidney opening, both openings being shown schematically in FIG. 5. FIG. 2 discloses that in the area of the output kidney opening, a pressure field 206 exists at the cover disc 204.

The prior art as represented by FIGS. 1 and 2 uses a rigid single piece height adjustment screw 200 with the advantage that the cam ring can roll along the height adjustment screw 200 if said cam ring is moved in the direction of the horizontal axis 201, i.e. the height level of the cam ring 6 is not changed during such a movement. However, the use of a rigid single piece height adjustment screw 200 has also disadvantages. In case that the planar surface of the height adjustment screw 200, a planar surface which abuts against the cam ring 6, is not parallel to the outer surface contact line of the cam ring 6, as is shown in FIG. 2, then a tilting moment of $F_s \times a$ is created. In this formula, $F_s$ is the force exerted by the system pressure of the pump on the cam ring 6, a force which acts in vertical direction, i.e. upwardly. Said force $F_s$ is balanced by a force $F_h$ of the same size provided by the height adjustment screw 200.

During normal operation of the pump, the cover disc 204 is pressed against the cam ring 6 due to a force $F_A$ of the pressure field 206 which acts contrary to a force Fi, a force which acts from the inside. The force $F_A$ must be larger than the force Fi so that no gap will be created between the cover disc 204 and the cam ring 6. In case the force $F_A$ is greater than the force Fi, then the cover disc 204 exerts the forces F1 and F2 onto the cam ring. If, however, the tilting moment $F_{hxa}$ is larger than $F_2 \times b$, then cam ring 6 tilts and the cover disc 204 would lift off the vanes of the pump. Such a lift off would lead to a failure of the pump. As shown in FIG. 2, the distance of the location where the force $F_h$ acts is designated "a" with respect to the vertical line 202. The letter "b" refers to the mean diameter of the cam ring 6. The reference numeral 2 refers to the rotor and 5 refers to the vanes of the rotor.

Figure 4:
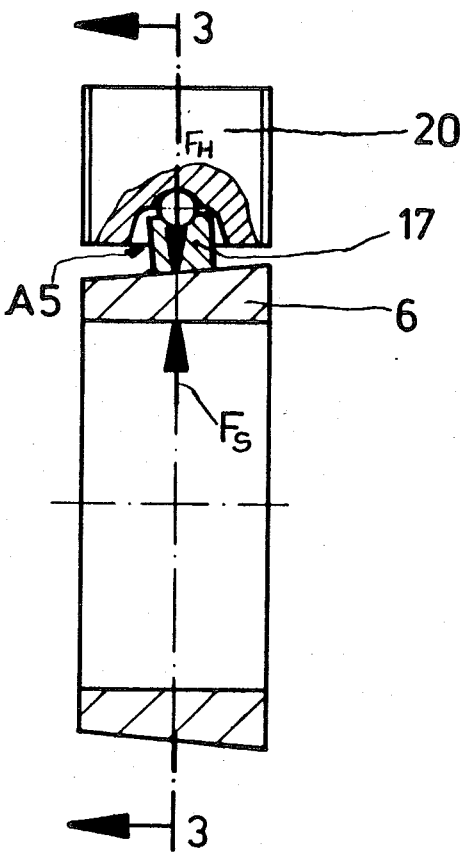
Fig. 4 (PRIOR ART)
FIG. 4 is a longitudinal cross-sectional view along line 4—4 in FIG. 3.
Figure 3:
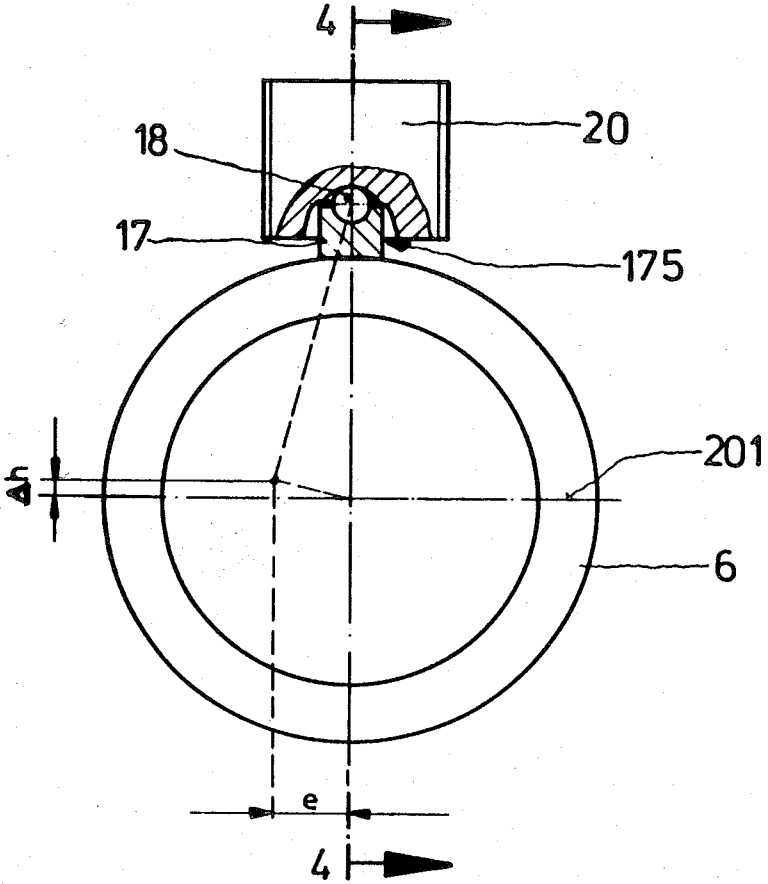
Fig. 3 (PRIOR ART)
FIG. 3 is a schematic cross-sectional view similar to FIG. 2 of another prior art vane-type pump with the sectional line running along line 3—3 in FIG. 4.
Figure 5:
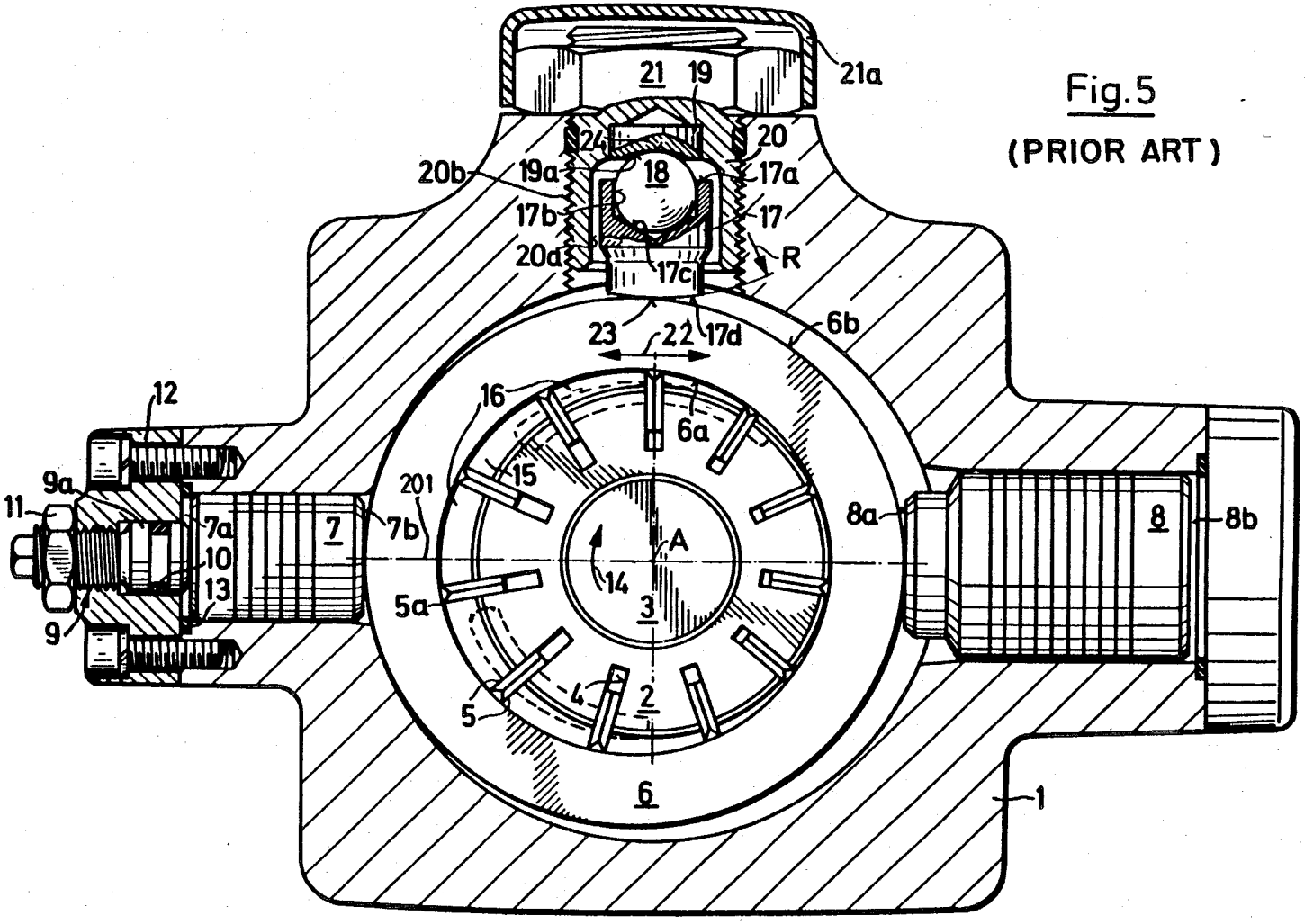
Fig. 5 (PRIOR ART)
FIG. 5 is a cross-sectional view similar to the schematic cross-sectional view of FIG. 3 showing a prior art type pump in more detail.

In the known pump design of FIGS. 3, 4 and 5, the single piece height adjustment screw 200 of FIGS. 1 and 2 is replaced by a height adjustment screw 20 and supporting means 175. Said supporting means 175 comprise a supporting body 17 in the form of a bolt and said supporting means 175 further comprise a ball 18 which is supported in the supporting body 17 as well as the height adjustment screw 20. Details of said construction are shown in FIG. 5. Prior to discussign the advantages and disadvantages of the known design of FIGS. 3, 4 and 5, the following description will now refer to FIG. 5 for a detailed explanation of the vane-type pump. Thereupon, based on the description of FIG. 5, the description of the invention shown in FIGS. 6 to 8 will begin.

In FIG. 5, the pump housing is referred to by reference numeral 1 and the rotor is referred to by reference numeral 2. The rotor is fixedly mounted to a shaft 3. Within slots 4 of the rotor, vanes 5 are slidably mounted. The outwardly directed ends of the vanes 5*a* are in slidable engagement with the inner surface 6*a* of the cam ring 6. At the outer surface 6*b*, the cam ring 6 is held at oppositely located sides by means of hydraulically actuated adjustment pistons 7 and 8. The movement of the adjustment piston 7 in the direction of maximum fluid supply is provided by abutment screw 9. The abutment screw 9 is sealed by means of a seal ring 10 in the area of a piston shaped extension 9. In order to make an accidental adjustment of the abutment screw 9 impossible, a counter nut 11 is provided. The abutment screw 9 is arranged in a cover 12 which provides a fluid-tight seal for the space 7*a* of the piston 7 by means of a seal ring 13. As afore-mentioned, FIG. 5 shows schematically a suction kidney opening and an output kidney opening by means of dashed lines.

For a rotation of the rotor 2 in the direction of the arrow 14, the pressure chambers 15 formed by said vanes 5 face towards the crescent shaped space 16 which is formed between the rotor and the cam ring. Consequently, at this side, the cam ring 6 is in abutment with the supporting body 17. A recess 17*b* is provided in the end 17*a* of the supporting body 17, i.e. the end facing away from the cam ring. Said recess is adapted to receive a ball 18 in a tight manner. The ball is supported on one hand by the cone shaped surface 17*c* of the recess 17*b*, and on the other hand by the spherical recess 19*a* of a pressure disc 19. The pressure disc 19 is inserted into said adjustment screw 20. The adjustment screw 20 is directly screwed into the pump housing 1 and comprises a recess 20*a* which surrounds the supporting body so as to provide for a space-saving arrangement of the supporting body within the pump housing. Again, a counter nut 21 is used so as to secure the adjustment screw 20 with respect to accidental rotation.

The radius of the spherical recess 19*a* of the pressure disc 19 is somewhat larger than the radius of the ball 18 and, therefore, somewhat larger than the normally provided play. This ensures that a reset moment is created which acts in the direction of the shown initial position of the cam ring and the supporting body 17. Surface 17*d* of the supporting body 17, which is in engagement with the outer surface 6*b* of the cam ring, comprises a radius R which extends in the direction of movement of the cam ring 6 in accordance with arrow 22, the radius R being larger than the distance between the line 23 of engagement between the cam ring and the surface 17*d* of the supporting body and the contacting point 24 between the ball 18 and the spherical recess 19*a* of the pressure disc 19.

In cases that a cam ring 6 is moved by means of adjustment pistons 7 and 8 in one direction of movement or the other, as represented by arrow 22, the outer surface 6*b* of the cam ring 6 will roll on the surface 17*d* of the supporting body 17, and the supporting body 17 will roll via the ball 18 on the spherical recess 19*a* of the pressure disc 19. This will simultaneously cause a small movement of the supporting body 17 in the direction of the rotor axis A. Said movement will balance the movement of the line 23 of contact, a movement which is caused by the rolling of the cam ring 6 on the supporting body 17 in the direction of the rotor axis A. A movement of the cam ring 6 transversely to the direction of adjustment by the adjustment pistons 7 and 8 is therefore impossible. Simultaneously, a frictional movement of the cam ring with respect to the supporting surfaces 7*b*, 8*a* of the adjustment pistons 7 and 8, respectively, is precluded so that an adjustment of the vane-type pump largely without hysteresis is achieved.

The adjustment of the cam ring 6 transversely with respect to the direction of adjustment of the adjustment pistons 7 and 8 is simply carried out by screwing the adjustment screw 20, carrying the pressure disc 19 into or out of the thread means 20*b*.

Although the design of FIGS. 3 to 5 works reasonably well, there exists the following disadvantage. Due to the low friction of the ball joint, formed by the support body 17 and the ball 18, the cam ring 6 and the bolt forming the support body 19 will pivot about the centre point of the ball 18, as is shown in FIG. 3. This pivotal movement will occur for each movement of the cam ring 6 in horizontal direction, i.e. in the direction of the horizontal axis 201. Due to this pivotal movement for each adjustment "e" (see FIG. 3) in horizontal direction, a change of the level of height of the cam ring 6 by $\Delta h$ also occurs. However, this leads to a change of the initial compression and, therefore, causes an undesirable influence on the control characteristic.

The present invention starts with the recognition that it would be desirable for an improved characteristic of stability of the pump to maintain the level of height of the cam ring 6 constant when the cam ring is adjusted in horizontal direction along the axis 201. Such a characteristic of stability should at least be achieved in an area of adjustment which is equal to one third of the maximum eccentricity "e".

In order to achieve this object, the invention provides support means for the cam ring 6, support means being mounted within the adjustment screw 20 in such a manner that a change of the level of height $\Delta h$ of the cam ring does not occur. The support menas preferably comprise a single piece support body. The term "single piece" means that, different from the design of FIGS. 3 to 5—a design which uses a ball 18 within the support body 17—only a rigid component is used.

Figure 6:
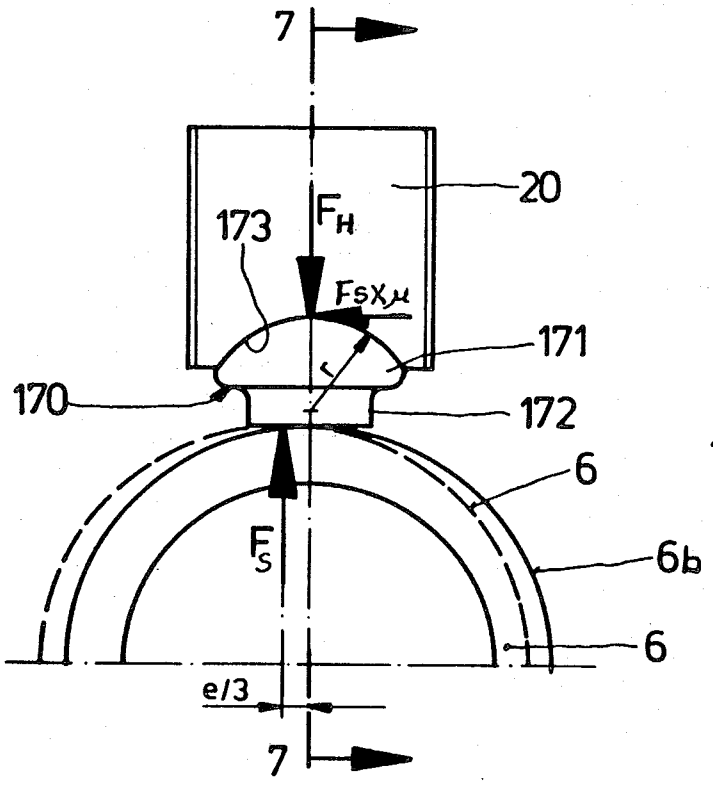
FIG. 6 is a schematic cross-sectional view similar to FIGS. 1 and 3 with the sectional line 6—6 in FIG. 7 and showing the pump of the invention of FIG. 8.

The invention will be described in detail in connection with FIGS. 6 to 8. FIG. 8 shows the support means of the invention in a partial sectional view of a pump of the type shown in FIG. 5. FIGS. 6 and 7 shows schematically the essential forces, which will be necessary in describing the invention. In FIG. 6, the cam ring 6 is shown in solid lines in its position corresponding to a zero supply of pressure medium. In FIG. 6, the cam ring 6 is shown with dashed lines in a position horizontally offset with respect to said zero supply position. The amount of said offset movement is referred to e/3. i.e. the movement shown is approximately one third of the possible maximum movement or displacement e.

In accordance with the preferred embodiment of the invention, the support means are formed by the single piece support body 170. On one hand, the support body 170 is pivotally supported in the adjustment screw 20 and is, on the other hand, supported by the outer surface 66 of the cam ring 6. The support body 170 comprises a spherical section 171 for mounting in the adjustment screw 20. The support body 170 further comprises a cylinder section 172 adapted for engagement with the cam ring 6. In general, the supporting body 170 can be said to have the shape of a mushroom. The spherical section 171 is pivotally mounted in a correspondingly shaped recess 173 of the adjustment screw 20. The diameter of the cylinder section 172 is slightly smaller than the largest diameter of the spherical section 171. The centre-point of the radius r defining the spherical section 171 is preferably—however, not necessarily—located on the centre axis of the cylinder section 172.

The surface **17*d* of the supporting body 170 which is in contact with the outer surface 6*b* of the cam ring 6** should be of planar shape.

Moreover, the invention discloses that the following condition is fulfilled so as to provide for a balance between the deviation from the surface contact line of the cam ring 6 with respect to the contacting surface **17*d* of the support body 170**: $F_s \times a > F_s \times \mu \times r$. Consequently, the following condition holds true: $a > \mu \times r$.

Again, similar to the disclosure in connection with FIGS. 1 to 4, $F_s$ refers to the force exerted by the cam ring 6 onto the supporting body 170. The letter a refers to the radius of the cylinder section 172, i.e. the contacting surface **17*d* of the support body 170. The Greek letter $\mu$ is the coefficient of friction which exists between the spherical section 171 and the recess 173. Thus, $F_s \times \mu$ is the frictional force which resists the tendency of the supporting body's spherical section to move relative to screw 20**.

If the condition $a > \mu \times r$ is fulfilled, this will ensure that a tilting movement of the cam ring does not occur.

In order to allow for a rolling movement of the cam ring 6 during an adjustment operation of the cam ring 6 in axial direction (longitudinal axis 201) for an area of movement up to e/3, the following condition must be fulfilled: $r \times F_s \times \mu > F_s \times e/3$. Therefore, the following is true: $r \times \mu > e/3$.

Preferably, the design of the support body 170 is provided such that both above-mentioned conditions are fulfilled, i.e. a is larger than the product of $\mu \times r$ and, furthermore, the product of $r \times \mu$ is larger the $\frac{1}{3}e$.

I claim:

1. An adjustable vane-type pump comprising:

a housing within which cam ring is located, a rotor rotatably mounted within said cam ring, means for adjusting the cam ring in horizontal direction so as to change the amount of fluid supplied by the pump, and supporting means arranged within a height level adjustment screw which is adapted to adjust the desired height level of the cam ring, said supporting means including a unitary supporting body, said supporting body having a spherical surface adapted to be pivotally mounted in the adjustment screw and an abutment surface for abutment with the outer surface of the cam ring, whereby an adjustment of the cam ring in the horizontal direction within a predetermined range does not change the height level of the cam ring.

2. The pump of claim 1, wherein the supporting body comprises a spherical section and a cylindrical section, said spherical section defining said spherical surface and said cylindrical section defines said abutment surface.

3. The pump of claim 1, wherein the abutment surface of the supporting body is of planar design.

4. The pump of claim 1, wherein the spherical surface of the supporting body has a predetermined radius r.

5. The pump of claim 2, wherein $a > \mu \times r$, with a being the radius of the cylinder section, $\mu$ being the friction coefficient and r being the radius of the spherical section.

6. The pump of claim 5, wherein $r \times \mu > e/3$ with r being the radius of the spherical section, $\mu$ being the friction coefficient and e being the maximum eccentricity of the cam ring in the direction of the horizontal axis.

* * * * *